US005632222A

United States Patent [19]

Fido

[11] Patent Number: 5,632,222

[45] Date of Patent: May 27, 1997

[54] LOAD ORIENTATING DEVICE

[76] Inventor: Peter M. Fido, Craig-Y-Ceilog Cottage, Craig-Y-Ceilog, Bettws, Newport, Gwent NP9 6AE, United Kingdom

[21] Appl. No.: 433,342

[22] PCT Filed: Nov. 4, 1993

[86] PCT No.: PCT/GB93/02277

§ 371 Date: Jun. 30, 1995

§ 102(e) Date: Jun. 30, 1995

[87] PCT Pub. No.: WO94/11294

PCT Pub. Date: May 26, 1994

[30] Foreign Application Priority Data

Nov. 7, 1992 [GB] United Kingdom ..... 9223399

[51] Int. Cl.[6] ..... B63G 8/14

[52] U.S. Cl. ..... 114/330; 74/5.22; 114/122; 212/273; 294/81.4

[58] Field of Search ..... 114/330, 122; 294/81.4; 414/754; 212/273; 244/165; 74/5.22, 5 R, 5.1, 5.8, 5.9

[56] References Cited

U.S. PATENT DOCUMENTS

| | | | |
|---|---|---|---|
| 769,693 | 9/1904 | Forbes | 74/5.22 |
| 3,203,644 | 8/1965 | Kellogg, Jr. | 244/165 |
| 3,210,114 | 10/1965 | Lawton | 294/81.4 |
| 3,608,384 | 9/1971 | Hardin | 74/5.22 |

FOREIGN PATENT DOCUMENTS

| | | |
|---|---|---|
| 0 023 381 | 4/1981 | European Pat. Off. . |
| 474880 | 3/1915 | France . |
| 289492 | 3/1914 | Germany . |
| 434716 | 9/1926 | Germany . |
| 1940375 | 7/1970 | Germany . |
| 2009847 | 9/1971 | Germany . |
| 2035367 | 1/1972 | Germany . |
| 1179943 | 4/1970 | United Kingdom . |
| 1182792 | 4/1970 | United Kingdom . |
| 1 244 674 | 2/1971 | United Kingdom . |
| 1 478 815 | 6/1977 | United Kingdom . |
| 2106245 | 4/1983 | United Kingdom . |

*Primary Examiner*—Sherman Basinger
*Attorney, Agent, or Firm*—Larson and Taylor

[57] ABSTRACT

A device (10) for orientating a load to be suspended and moved by a crane includes a flywheel (11) mounted for rotation in a housing (14). A turntable (17) is pivotally connected to the housing (14) and is drivable relative to the housing using a driven worm gear (23) meshing with an annular set of teeth (22) on the turntable (17). The turntable has an axle (18) to which loads can be attached. When the flywheel (11) is spinning at high speed, it resists movement out of its plane of rotation so as to stabilize the cable in winds, etc. The flywheel (11) also allows the worm gear to react against it so as to turn the load relative to the flywheel (11). Maneuvering of the load is therefore made easier.

9 Claims, 4 Drawing Sheets

LOAD ORIENTATING DEVICE

FIELD OF THE INVENTION

This invention relates to a load orientating device.

SUMMARY OF THE INVENTION

According to the present invention there is provided a load orientating device comprising a flywheel mounted in a flywheel housing for rotation therein about an axis such that, in use, the flywheel is able to rotate only in a single plane, drive means for rotating the flywheel, turntable means pivotally connected to said housing for selective rotation about a second axis and adapted to be secured to said load and second drive means fixed relative to the housing for rotating said turntable means.

Preferably said plane of rotation of the flywheel is substantially vertical, said first axis is substantially horizontal, and said second axis is substantially vertical and perpendicular to said first axis.

In one embodiment said flywheel housing is adapted to be suspended on the lifting cable means of a crane such that the second axis is coaxial relative to the general lengthwise axis of the cable means. Conveniently said second drive means comprises a motor and gear means, the turntable means also being provided with corresponding means for meshing with said gear means, preferably in the form of an annular array of teeth. In one embodiment the gear means comprises a worm gear.

In another embodiment of the present invention the turntable means is attached to the hull of a vessel such that rotation of the turntable means changes the orientation of the hull about the second axis of the turntable means.

In a preferred embodiment the vessel is a submersible vessel and said hull encloses the load orientating device.

It is a further preferred feature that a further load orientating device is attached to the hull with said second axis perpendicular to the second axis of the first device so as to move selectively the hull in a perpendicular plane.

BRIEF DESCRIPTION OF THE DRAWINGS

Embodiments of the present invention will now be described in more detail. The description makes reference to the accompanying drawings in which.

DESCRIPTION OF THE PREFERRED EMBODIMENTS

Figure 1:
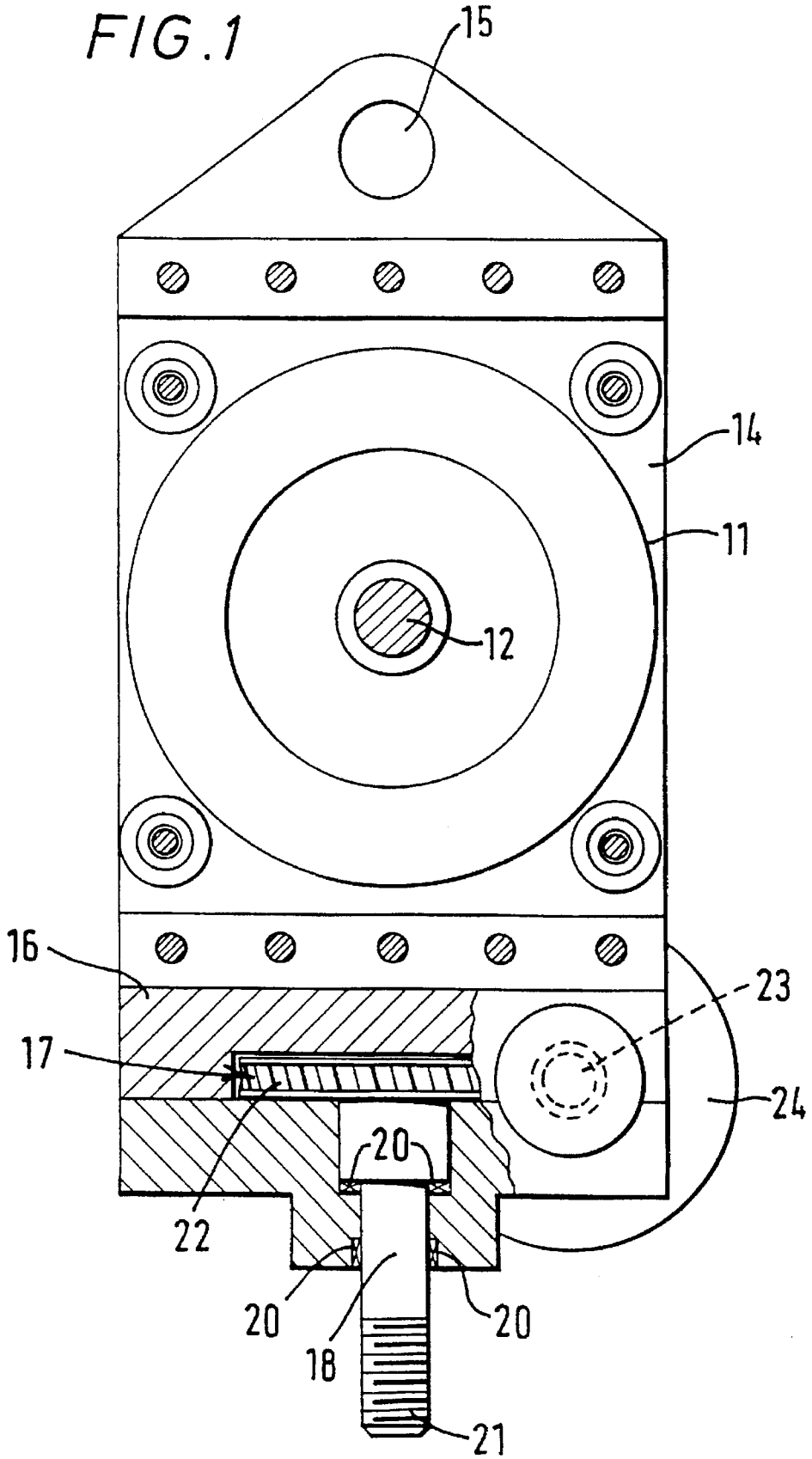
FIG. 1 is a schematic part-sectional side view of a load orientating device according to the present invention.
Figure 2:
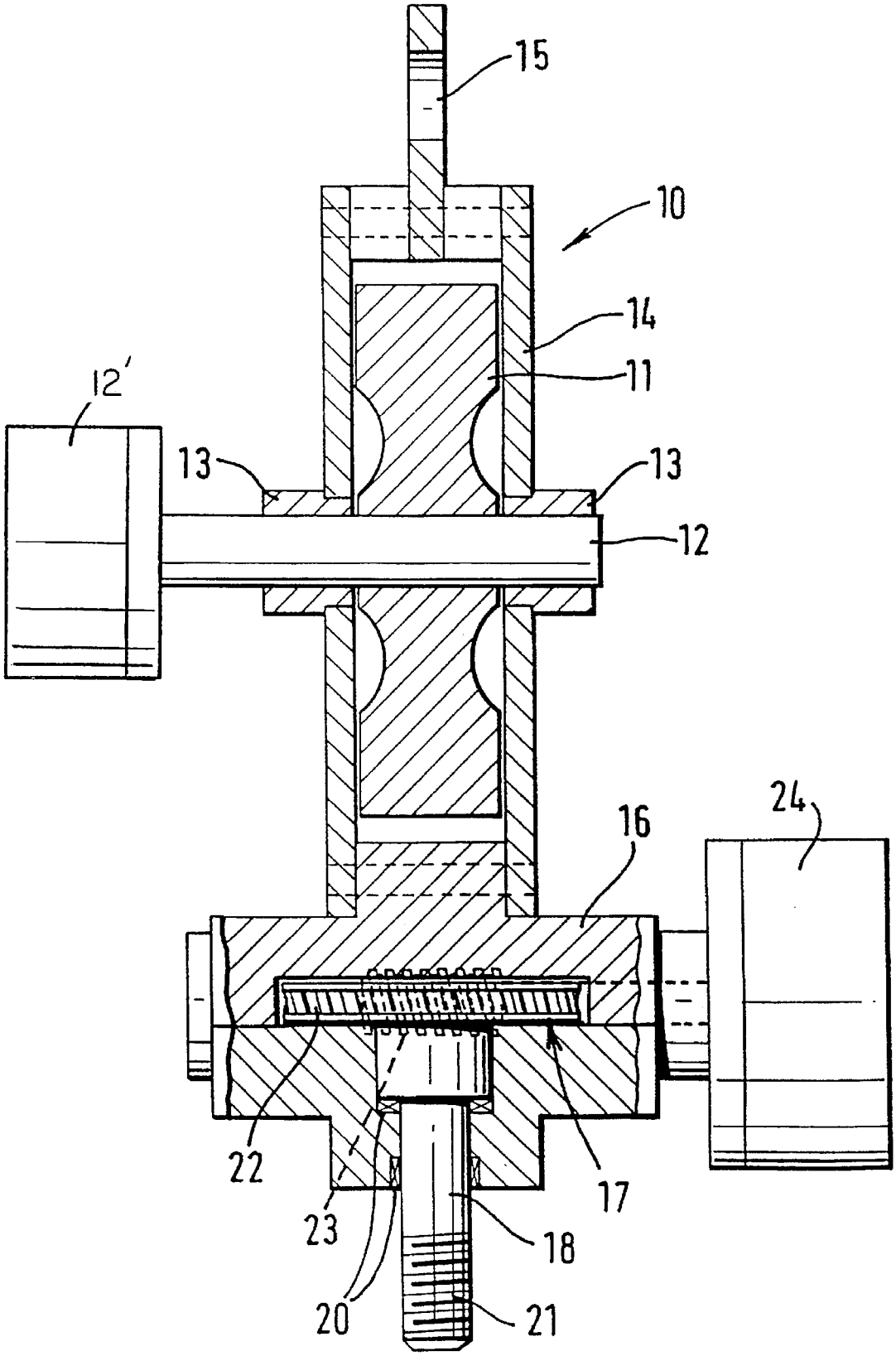
FIG. 2 is a schematic part-sectional front view of the device of FIG. 1.

FIGS. 1 and 2 show a load orientating device 10 for use with a crane or even with a load suspended from any suitable height such as a building or an aircraft. The following discussion will, however, only mention the crane application.

The device 10 comprises a flywheel 11 secured on a shaft 12 mounted in bearings 13 in a flywheel housing 14 which in this embodiment is fully enclosed for safety purposes. The shaft 12 is adapted to be driven in rotation by motor means 12' at high speed. The housing 14 incorporated a hole 15 by which the device 10 can be secured to the lifting cable or cables of the crane.

Disposed in the base 16 of the housing 14 is a turntable 17 having an axle 18. The turntable 17 is able to rotate relative to the housing 14, which rotation is facilitated by the provision of annular bearings 20. The free end 21 of the axle 18 is adapted to have a load secured to it by any suitable means. The turntable 17 is generally circular and is formed with teeth 22 around its periphery.

The teeth 22 of the turntable 17 mesh with a worm gear 23 which is mounted for rotation in the base 16 of the housing 14. The worm gear 23 is driven by a second motor 24 which is secured relative to the housing 14 and which can be selectively actuated to move the worm gear 23 in either rotational direction thereby moving the turntable 17 in either direction relative to the housing 14.

When the device 10 is to be used it is attached to the cable means of the crane. The flywheel motor is actuated and the flywheel 11 is caused to rotate at high speed. The precise speed will of course depend on the loads which are to be moved and also on the geometry of the flywheel 11 itself. The high speed rotation of the flywheel 11 results in the flywheel 11 having a strong tendency to remain in a single plane by virtue of the gyroscopic effect. Thus the arc-like movement of the jib of the crane results in the flywheel remaining in parallel planes when the jib is moved. If a load is attached to the end 21 of the turntable axle and the jib is moved then the load retains its orientation relative to the housing 14.

The inertia of the spinning flywheel 11 is sufficient for the worm gear 23 to react against such that when the worm gear is turned, the load is able to rotate relative to the flywheel 11 and its housing 14. This relative rotation of the load does not affect the orientation of flywheel 11 to a material extent.

It will be appreciated also that the inertia of the spinning flywheel 11 also resists movement of the housing as a result of external forces such as wind. This ensures that the crane cable, the flywheel and its housing, and the load remain in vertical alignment throughout manoeuvres.

The stability and orientating ability of the device means that it will not be necessary for a load to be guided and stabilised by men holding guide ropes as is the present technique. The device 10 resists movement of the flywheel out of its plane of spinning.

Figure 3:
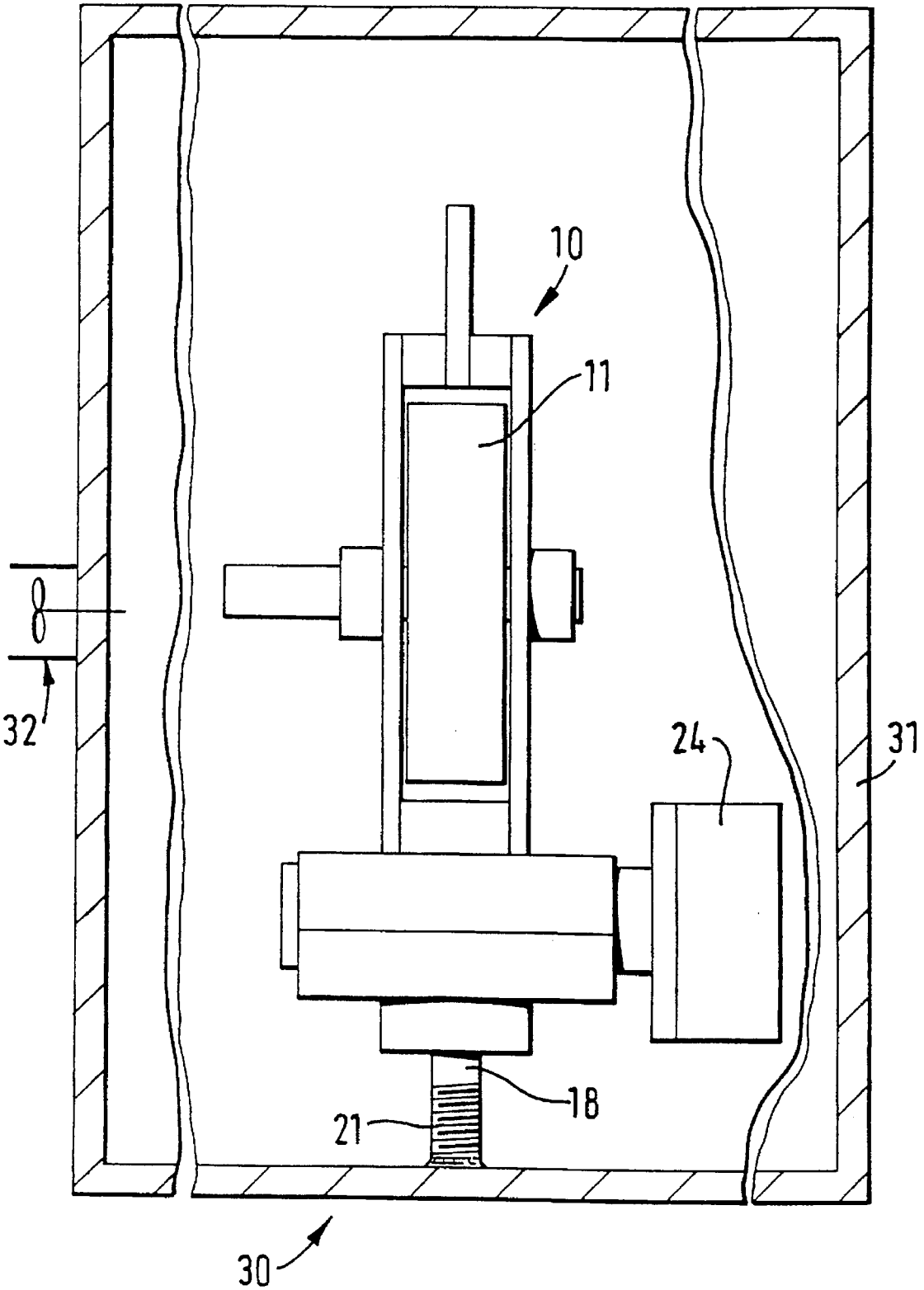
FIG. 3 is a schematic sectional view through a vessel incorporating a load orientating device according to the present invention.

In FIG. 3 there is shown a submersible vehicle 30 or ROV having a hull 31 and a propulsion means 32. Such vehicles are used to observe and film the ocean or structures located underwater such as oil platforms and pipelines or even the undersides of ships. Normally such vehicles have a number of directional drive means or boosters for altering the orientation of the vehicle. However, such boosters tend to disturb the ocean floor or cause excessive turbulence.

The vehicle 30, therefore, incorporates a load orientating device 10, the load being the hull 31 which is attached to the free end 21 of the turntable axle 18. In use the flywheel 11 is rotated at high speed and the hull 31 can be orientated by selective rotation of the turntable motor 24. The flywheel 11 remains in the same plane while the hull 31 of the vehicle is rotated so as to face in a different direction.

Figure 4:
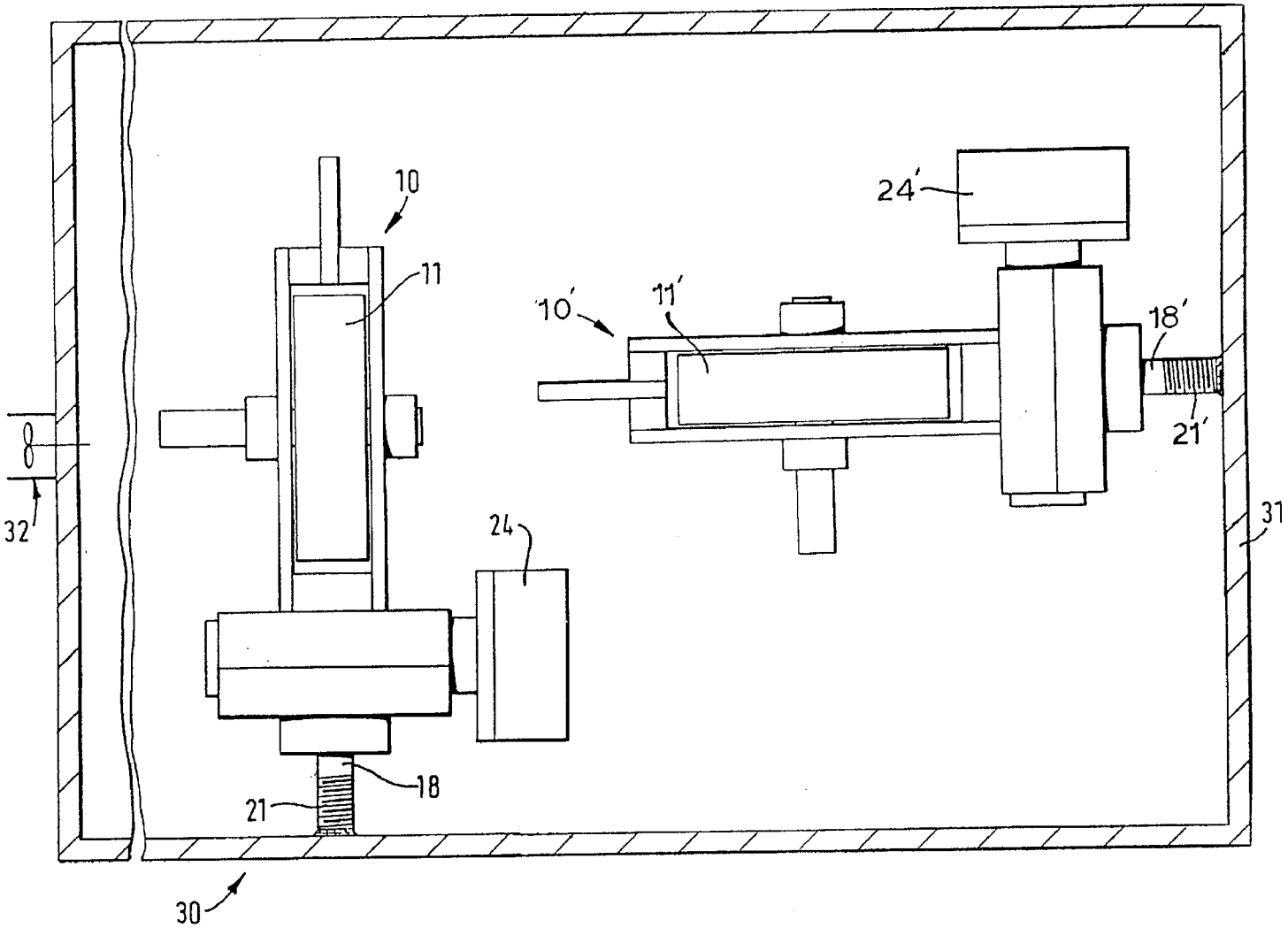
FIG. 4 is a schematic sectional view through a vessel incorporating two load orientating devices according to the present invention.

A second device 10' could also be mounted in the vehicle as shown in FIG. 4 such that the turntable axle 18' is also attached to the hull 31 but is perpendicular to the axle 18 of the first device. In this way the second device 10 could be used to control the pitch and yaw of the vehicle 30.

It will be appreciated that the shape, size and speed of the flywheel are a matter of design choice depending on the future purposes of the device. Although a worm-driven turntable has been described, other suitable drive means are possible both for the turntable and also the flywheel itself.

We claim:

1. A load orientating device for a load comprising:

a flywheel a flywheel housing having a first axis fixed with respect to said housing about which the flywheel is mounted for rotation such that, in use, the flywheel rotates only in a single plane relative to the housing, a drive means for rotating the flywheel, a turntable means, connected to said housing for selective rotation about a second axis, for securing the load rotatably relative to the housing, and a second drive means fixed relative to the housing for rotating said turntable means.

2. A load orientating device as claimed in claim 1 wherein said plane of rotation of the flywheel is substantially vertical, said first axis is substantially horizontal, and said second axis is substantially vertical and perpendicular to said first axis.

3. A load orientating device as claimed in claim 2 wherein said flywheel housing includes a member by which said housing is adapted to be suspended on a lifting cable of a crane such that the second axis is coaxial relative to the general lengthwise axis of the cable.

4. A load orientating device as claimed in claim 3 wherein said second drive means comprises a motor and gear means, the turntable means also being provided with corresponding means for meshing with said gear means.

5. A load orientating device as claimed in claim 4 wherein said corresponding means is in the form of an annular array of teeth.

6. A load orientating device as claimed in claim 4 wherein the gear means comprises a worm gear.

7. A load orientating device as claimed in claim 1 wherein the turntable means is attached to the hull of a vessel such that rotation of the turntable means changes the orientation of the hull about the second axis of the turntable means.

8. A load orientating device as claimed in claim 7 wherein the vessel is a submersible vessel and said hull encloses the load orientating device.

9. A load orientating device as claimed in claim 8 wherein a further load orientating device is attached to the hull with a second axis thereof perpendicular to the second axis of the first device so as to move selectively the hull in a perpendicular plane.

* * * * *